US006499957B1

(12) United States Patent
Klingels et al.

(10) Patent No.: US 6,499,957 B1
(45) Date of Patent: Dec. 31, 2002

(54) ROTOR FOR A TURBOMACHINE

(75) Inventors: Hermann Klingels, Eching (DE); Martin Fischer, Olching (DE)

(73) Assignee: MIU Aero Engines GmbH, Munich (DE)

( * ) Notice: Subject to any disclaimer, the term of this patent is extended or adjusted under 35 U.S.C. 154(b) by 0 days.

(21) Appl. No.: 09/720,504

(22) PCT Filed: Jun. 24, 1999

(86) PCT No.: PCT/DE99/01840

§ 371 (c)(1),
(2), (4) Date: Jun. 8, 2001

(87) PCT Pub. No.: WO00/00719

PCT Pub. Date: Jan. 6, 2000

(30) Foreign Application Priority Data

Jun. 27, 1998 (DE) ..... 198 28 817

(51) Int. Cl.[7] ..... B64C 27/32
(52) U.S. Cl. ..... 416/198 A
(58) Field of Search ..... 416/198 A, 201 R, 416/220 R; 415/173.7, 174.4, 174.5

(56) References Cited

U.S. PATENT DOCUMENTS

| | | | | |
|---|---|---|---|---|
| 2,614,796 A | | 10/1952 | Miller | 403/410 |
| 4,623,298 A | * | 11/1986 | Hallinger et al. | 415/139 |
| 4,844,694 A | | 7/1989 | Naudet | 416/198 A |
| 5,052,891 A | | 10/1991 | Burkholder | 416/198 A |
| 5,350,278 A | | 9/1994 | Burge | 416/198 A |
| 5,388,963 A | | 2/1995 | Dimmik et al. | 416/198 A |

FOREIGN PATENT DOCUMENTS

| | | |
|---|---|---|
| DE | 21 04 172 | 11/1971 |
| DE | 196 27 386 | 1/1997 |

* cited by examiner

*Primary Examiner*—Edward K. Look
*Assistant Examiner*—Dwayne J. White
(74) *Attorney, Agent, or Firm*—Kenyon & Kenyon

(57) ABSTRACT

A rotor for a turbomachine, having at least two bladed stages, the discs of which are detachably connected to one another, in which rotor, in order to avoid notch locations in the highly stressed discs, a first disc, at least at one side face, has a first flange which is connected to or restrained with a second flange of an adjacent disc by bolts.

13 Claims, 3 Drawing Sheets

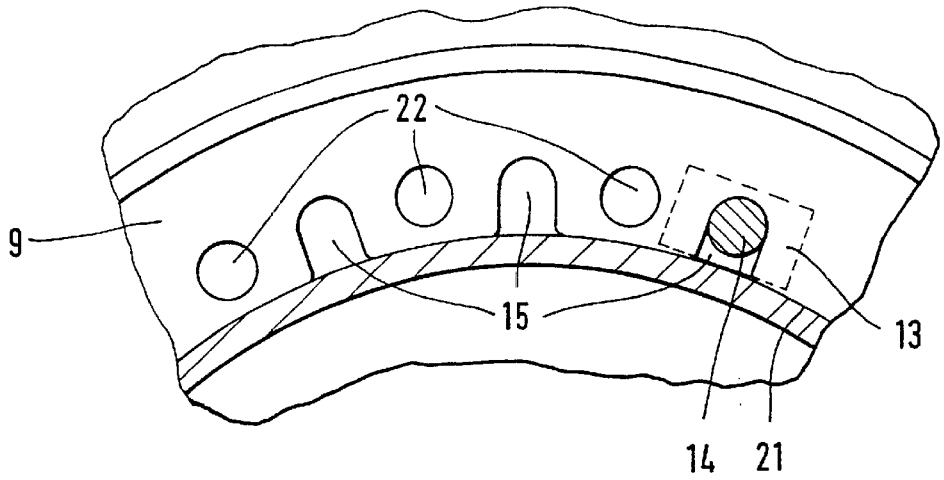
Fig. 2
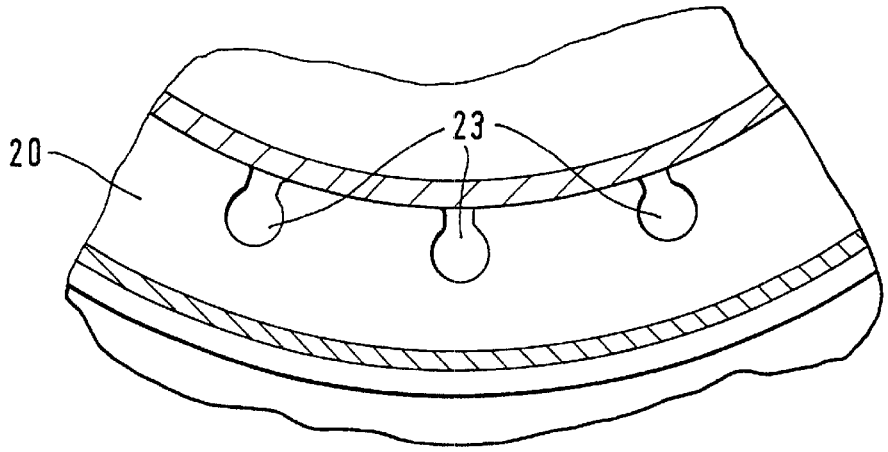

ROTOR FOR A TURBOMACHINE

FIELD OF THE INVENTION

The present invention relates to a rotor for a turbomachine, having at least two bladed stages, the discs of which are detachably connected to one another.

BACKGROUND INFORMATION

Rotors of turbomachines generally have a plurality of stages, which are provided with blades and the discs of which are connected to one another in different ways, e.g. by welding or detachably by bolting. Only stages which are detachably connected to one another are considered in this case.

In a known rotor, the discs have cylindrical or conical shells which extend essentially in the axial direction and on whose end sections in each case flanges in the shape of a disc ring are provided, to which adjacent discs are connected by screws, studs or the like. If an intermediate-stage seal is not integrated in the shells, it is in each case clamped in place between the flanges. Such a type of connection can only be used in the case of components having a relatively low circumferential velocity, such as, for example, slow-speed low-pressure turbines, since the centrifugal forces which occur in the case of discs designed for high circumferential velocities produce excessive circumferential stresses in the flanged connection. The bores in the flanges constitute notch locations causing local stress increases and greatly restrict the cyclical service life of the component.

German Published Patent Application No. 196 27 386 discloses a connecting arrangement for two turbine rotor discs which each have disc connecting arms with through-bores into which specially designed threaded bolts for connecting the rotor discs are inserted. The fact that radial expansion of the flanged connection occurs as a result of centrifugal-force effect proves to be disadvantageous especially at high circumferential velocities.

U.S. Pat. No. 5,388,963 discloses a rotor for compressors of gas turbines, in which rotor adjacent discs are detachably connected by flanges, a first flange having slots and a second flange having holes for receiving connecting bolts, and a separate clamp with opposite tongues, which can be bent, being used in order to prevent turning of the connecting bolt during assembly and dismantling.

German Published Patent Application No. 2 104 172 discloses a turbine rotor and a method of producing it, in which adjacent discs are clamped together via inwardly directed flanges having aligned bolt bores through which a bolt is passed in each case. A problem in this case is that the bolt bores in the flange constitute notch locations causing local stress increases and restrict the cyclical service life of the rotor.

U.S. Pat. No. 5,350,278 discloses an arrangement of spaced apart rotor discs which are detachably bolted to one another via flanges provided on spacers, an annular space along a disc pair for structural support being defined by the spacers. For the bolting, bores, which constitute notch locations, are provided in the flanges.

In high-speed low-pressure turbines, additional discs extending radially inwards have been provided, for example, at the intermediate-stage seals.

This is intended to limit the radial expansion in such a way that the circumferential stresses produced as a result of the centrifugal -force effects are kept at a low level and the requisite cyclical service life is achieved. However, the additional discs lead to considerable weight disadvantages and problems during assembly.

In a further known turbine, the disc has bores through which it is connected by bolting to adjacent discs which have cylindrical or conical shells with flanges. The disc body limits the radial expansion of the connecting point as a result of centrifugal-force effect. A problem, however, is that the bores in the highly loaded disc body constitute notch locations, which limit the service life.

U.S. Pat. No. 4,844,694 discloses a connection of rotor elements of a gas turbine in which the disc lying at the connecting point has a bore for inserting a bolt, the bores in the highly loaded disc body constituting notch points, which limit the service life. The last mentioned disadvantage also exists in the bolt connection disclosed by U.S. Pat. No. 5,052,891 between rotor elements of a gas turbine, in which bolt connection a bore for the same is provided in the disc lying at the connecting point.

SUMMARY OF THE INVENTION

An object of the present invention is to provide a rotor for a turbomachine of the generic type described at the beginning, in which rotor the discs are detachably connected to one another without extreme stress increases occurring due to notch locations in the disc.

The advantage of such a refinement consists in the fact that the radial expansion of the flanged connection by the disc body is limited, but the disc itself has no bores or notch locations which cause the local stress increases, which are partly extremely high.

The first flange preferably extends radially inwards at an axial distance from the side face of the first disc while forming an intermediate space.

The first flange is designed as a disc ring which has apertures along its inner end edge or circumferential edge.

The apertures are open towards the inside, so that the centrifugal force produced by the bolts can be absorbed by the marginal surface of the apertures.

Furthermore, it is advantageous that the apertures are arranged equidistantly along the circumferential edge.

To reduce the notch effect, in each case a bore, an elongated hole or a further aperture may be provided between the apertures.

It is highly preferable for a flange section of an intermediate-stage seal to be clamped in place in each case between the first and second flanges, the flange section of the intermediate-stage seal preferably having bores which are in alignment with the apertures of the first flange and fix the bolts in the radial direction during assembly.

Furthermore, it is expedient that the bolts, at their ends facing the first disc, have a transverse portion which extends at right angles to their longitudinal axis and with which they are supported on the inner side face of the first flange. The bolts are preferably T-head bolts.

The distance of the first flange from the side face of the first disc is preferably as small as possible, but greater than the thickness of the transverse portion of the bolt in order to avoid a pressure point at the highly loaded, first disc.

The flange of an adjacent disc, at its radially inner end, has a supporting portion which extends substantially in the axial direction and on which the transverse portion of the bolts is supported in order thus to provide anti-rotation locking of the bolts.

In a preferred refinement, the first disc has a first flange at both side faces, so that, in this way, the discs of rotors having more than two stages can also be detachably connected.

BRIEF DESCRIPTION OF THE DRAWINGS

FIG. 2 shows a truncated cross-sectional view along line II—II from FIG. 1.

DETAILED DESCRIPTION

Figure 1:
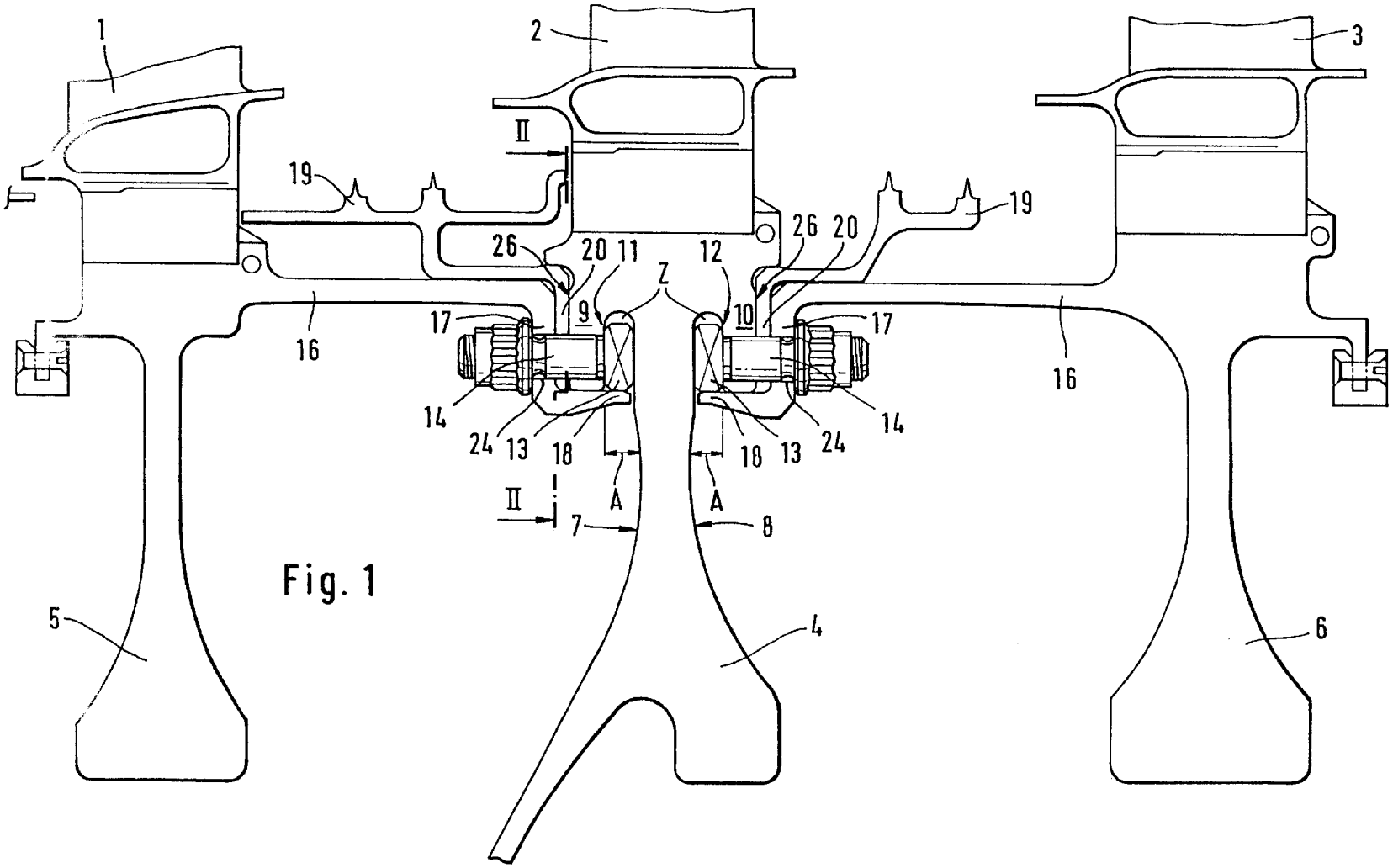
FIG. 1 shows, in longitudinal section, a view of an exemplary embodiment of the rotor according to the present invention, this view having no hatching for the sake of clarity.

FIG. 1 shows a longitudinal section of an exemplary embodiment of the rotor according to the present invention for a turbomachine, this rotor having three stages. The stages are each provided with a blade 1, 2 and 3 and with a first disc 4 and two adjacent discs 5,6. The first disk 4 has a flange 9 and 10 respectively at each of its two side faces 7, B. The flanges 9, 10 extend at an axial distance A from their inner side faces 11, 12 to the side faces 7, 8. In this way, there is an intermediate space Z, which is open towards the inside in the radial direction, between the first disc 4 and the flanges 9, 10. The distance A is to be kept as small as possible in order to limit the radial expansion of the flanges 9, 10 or the flanged connection by the body of the disc 4.

For the detachable connection of adjacent discs 5, 6, a transverse portion 13 of a (screw) bolt 14 engages in the intermediate space Z and is supported in each case on the inner side face, such as 12 for example, of the flange 10 after the restraining/bolting.

The discs 5, 6 adjacent to the center, first disc 4 each have cylindrical shells 16 which extend substantially in the axial direction and may also be of conical design. At their ends remote from the discs 5, 6, the shells 16 each have a second flange 17, which in each case is firmly restrained with the flanges 9, 10 of the first disc 4 by (screw) bolts 14 or the like. A supporting portion 18 running essentially in the axial direction in each case adjoins the second flanges 17 of the discs 5, 6, on which supporting portion 18 the transverse portions 13 of the bolts 14 can be supported, as a result of which rotation of the bolts 14 is prevented. This ensures that no pressure points occur at the highly loaded, first discs 4 during the fitting or tightening of the (screw) bolts 14.

In each case an intermediate-stage seal 19 is clamped in place and detachably fastened with its flange section 20 between the flanges 9, 10 of the first disc 4 and the flanges 17 of the two adjacent discs 5, 6. Alternatively, the intermediate-stage seals 19 may also be arranged integrally on the discs 5, 6 or their shells 16.

FIG. 2 shows a cutaway and truncated crosssectional view along line II—II from FIG. 1, in the top partial cutaway portion of which the flange 9 is shown in a plan view. The flange 9 is designed as a disc ring, on the inner end face or circumferential edge 21 of which slot-like apertures 15 which are open towards the inside in the radial direction are provided. Inserted into one aperture 15 is a (screw) bolt 14, the transverse portion 13 of which is shown by a broken line. After fitting, this transverse portion 13 is supported on the inner side face 11 of the flange 9. In addition, in order to prevent the (screw) bolt 14 from rotating during the assembly,. its transverse portion 13 is supported on the supporting portion 18 of the shell 16 of the adjacent disc 5. Provided in each case between the apertures 15 is a relief bore 22, which reduces the notching factor as a result of the aperture 15. Alternatively, the bores 22 may also be designed as elongated holes, further apertures or the like.

Shown in the bottom partial cutaway portion from FIG. 2 is the flange section 20 of the intermediate stage seal 19, this flange section 20 being designed in the shape of a disc ring and having bores 23. The bores 23 are in alignment with the apertures 15 in the flanges 9, 10 of the first disc 4 as are corresponding bores 24 in the second flanges 17 of the discs 5, 6 adjacent to the first disc 4. As can be seen in FIG. 2, the bores 23 in the flange section 20 of the intermediate-stage seal 19 are open radially towards the inside, their degree of opening being less than their diameter, in order thus to ensure radial fixing of the (screw) bolts 14 during the assembly. Alternatively, the bores 23 may also be designed as closed bores.

If a rotor has more than three stages, every second stage is provided with a first disc 4 having at least one flange 9 or 10.

Figure 3:
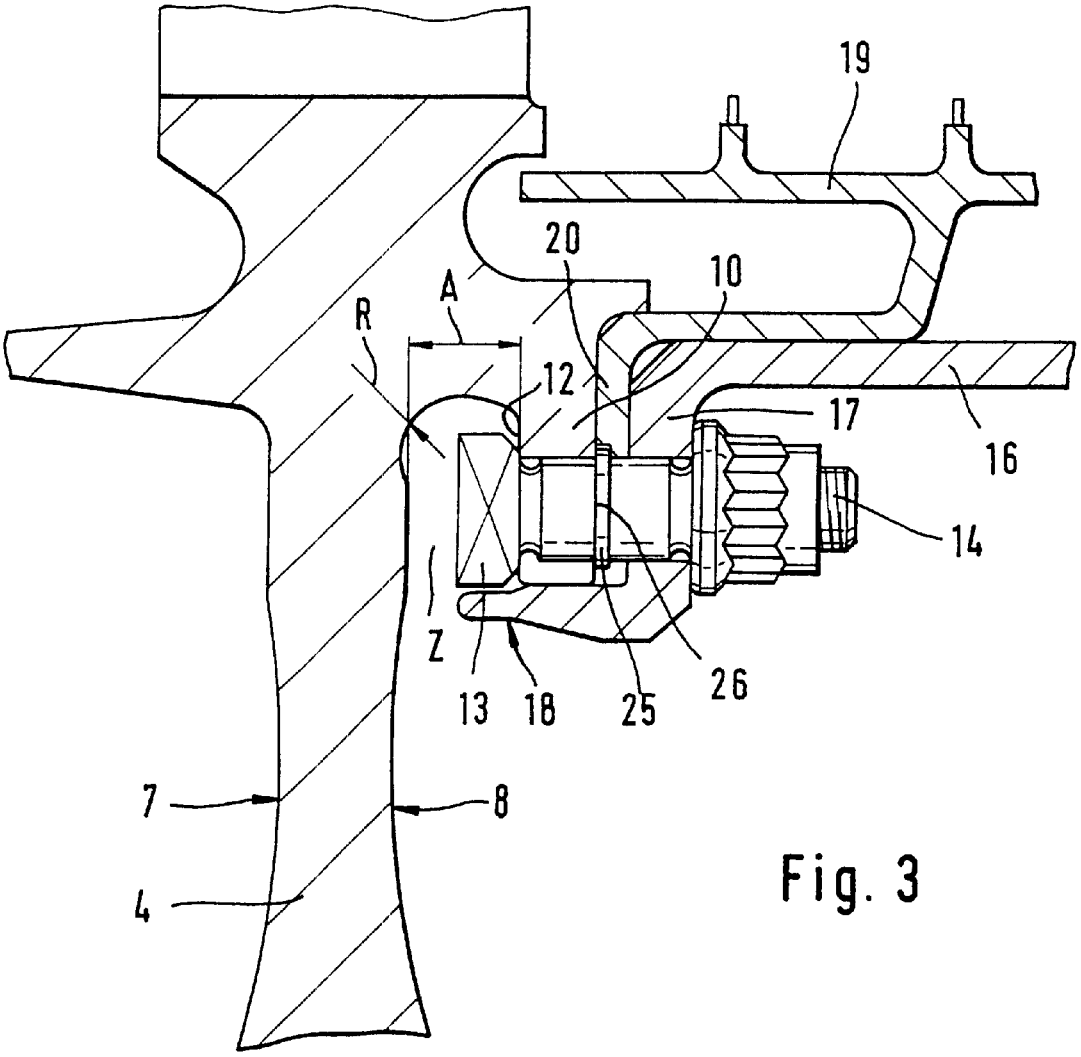
FIG. 3 shows, in longitudinal section, a truncated view of a further exemplary embodiment of the rotor according to the present invention.

FIG. 3 shows a further exemplary embodiment of the rotor according to the invention, in which the radius R at the transition between the inner side face 8 of the first disc 4 and the flange 10 or its inner side face 12 is increased for strength reasons. Since the distance A between the side face 8 of the first disc 4 and the inner side face 12 of the flange 10 is consequently larger, the (screw) bolt 14 has a shear ring or collar 25, which rests on an outer side face 26 of the flange 10 and prevents an axial displacement of the (screw) bolt 14, so that the transverse portions 13 are not pressed against the first disc 4 during the assembly and do not lose their anti-rotation locking.

What is claimed is:

1. A rotor for a turbomachine, comprising:

at least two bladed stages including a plurality of discs that are detachably connected to one another, wherein:

a first disc of the plurality of discs includes, at least at a side face thereof, a first flange that with an inner side face thereof is at as small a distance as possible therefrom, the first flange corresponds to a disc ring including a plurality of apertures arranged along an inner circumferential edge thereof, and the plurality of apertures open radially towards an inside; and a plurality of bolts by which the first disc is connected to a second flange of an adjacent disc of the plurality of discs, wherein:

each of the bolts includes a transverse portion, each transverse portion is supported on the inner side face of the first flange after a fitting, and the second flange, at the adjacent disc, includes a supporting portion extending substantially in an axial direction and on which the transverse portions of the bolts are supported.

2. The rotor according to claim 1, wherein:

the first flange extends radially inwards at an axial distance from the side face of the first disc.

3. The rotor according to claim 1, wherein:

the plurality of apertures are arranged equidistantly.

4. The rotor according to claim 1, wherein:

the disc ring includes one of a bore and an aperture between the plurality of apertures.

5. The rotor according to claim 1, wherein:

the second flange includes a plurality of bores in alignment with the plurality of apertures of the first flange.

6. The rotor according to claim 1, further comprising:

an intermediate-stage seal including a flange section that is clamped in place between the first flange and the second flange.

7. The rotor according to claim 6, wherein:

the flange section of the intermediate-stage seal includes a plurality of bores in alignment with the plurality of apertures of the first flange.

8. The rotor according to claim 7, wherein:

the plurality of bores of the flange section fixes the bolts in a radial direction.

9. The rotor according to claim 1, wherein:

each one of the bolts, at an end thereof facing the first disc, includes the respective transverse portion extending at right angles to a longitudinal axis of the respective bolt.

10. The rotor according to claim 1, wherein:

the bolts include T-head bolts.

11. The rotor according to claim 1, wherein:

a distance of the first flange from the side face of the first disc is greater than a thickness of the transverse portion.

12. The rotor according to claim 1, wherein:

each one of the bolts includes a collar that is supported on an outer side face of the first flange.

13. The rotor according to claim 1, wherein:

the first flange of the first disc includes two first flanges, the side face of the first disc includes two side faces, and each of the two first flanges is arranged at a corresponding one of the two side faces.

* * * * *

UNITED STATES PATENT AND TRADEMARK OFFICE

CERTIFICATE OF CORRECTION

PATENT NO. : 6,499,957 B1
APPLICATION NO. : 09/720504
DATED : December 31, 2002
INVENTOR(S) : Klingels et al.

It is certified that error appears in the above-identified patent and that said Letters Patent is hereby corrected as shown below:

On the face of the patent, in section (73) Assignee, please delete "MIU" and insert --MTU--.

Signed and Sealed this

Seventeenth Day of July, 2007

JON W. DUDAS
*Director of the United States Patent and Trademark Office*